US012601498B2

(12) United States Patent
Hu

(10) Patent No.: US 12,601,498 B2
(45) Date of Patent: Apr. 14, 2026

(54) UMBRELLA-SHAPED HEATER

(71) Applicant: Xiaocun Hu, Guangdong (CN)

(72) Inventor: Xiaocun Hu, Guangdong (CN)

( * ) Notice: Subject to any disclaimer, the term of this patent is extended or adjusted under 35 U.S.C. 154(b) by 422 days.

(21) Appl. No.: 18/277,081

(22) PCT Filed: Mar. 8, 2023

(86) PCT No.: PCT/CN2023/080185

§ 371 (c)(1),
(2) Date: Aug. 14, 2023

(87) PCT Pub. No.: WO2023/179359

PCT Pub. Date: Sep. 28, 2023

(65) Prior Publication Data

US 2025/0354692 A1 Nov. 20, 2025

Related U.S. Application Data

(60) Provisional application No. 63/321,766, filed on Mar. 20, 2022.

(51) Int. Cl.

| | |
|---|---|
| ***F24C 3/04*** | (2021.01) |
| ***F24C 1/12*** | (2021.01) |
| ***F24C 15/22*** | (2006.01) |

(52) U.S. Cl.
CPC ..... *F24C 3/042* (2013.01); *F24C 1/12* (2013.01); *F24C 15/22* (2013.01)

(58) Field of Classification Search
CPC ..... F24C 1/12; F24C 1/10
(Continued)

(56) References Cited

U.S. PATENT DOCUMENTS 1,395,485 A * 11/1921 Duncan ..... C10H 21/00 150/901
1,873,590 A * 8/1932 James ..... F16L 27/113 277/625

(Continued)

FOREIGN PATENT DOCUMENTS

CN 1407283 4/2003
CN 201028636 2/2008

(Continued)

OTHER PUBLICATIONS

"International Search Report (Form PCT/ISA/210) of PCT/CN2023/080185," mailed on Jul. 12, 2023, pp. 1-5.

(Continued)

*Primary Examiner* — Jorge A Pereiro
(74) *Attorney, Agent, or Firm* — JCIPRNET

(57) ABSTRACT

The invention relates to heating equipment. An umbrella-shaped heater comprises a base component, a support pipe and a burner component, the base component comprises a flexible housing, the burner component comprises a top cover located above the burner and used for reflecting the heat of the burner, and a reflecting surface adjusting structure is installed on the top cover for adjusting the angle of the top cover. The invention provides an umbrella-shaped heater with detachable components, thereby greatly reducing the packaging volume and transportation cost and improving the economic effectiveness, and the angle of the top cover can be adjusted to meet the requirements of different users. The invention solves the technical problems in the prior art that an umbrella-shaped heater is of an integral structure, so the packaging volume is large and the transportation cost is high, and moreover, the angle of a top cover cannot be adjusted.

17 Claims, 5 Drawing Sheets

(58) Field of Classification Search
USPC ..... 150/154, 158, 165
See application file for complete search history.

(56) References Cited

U.S. PATENT DOCUMENTS

| | | | | | |
|---|---|---|---|---|---|
| 2,916,306 | A * | 12/1959 | Rickard | F16L 17/035 | 285/393 |
| 3,304,104 | A * | 2/1967 | Wiltse | F16L 21/02 | 277/609 |
| 3,762,438 | A * | 10/1973 | Litchfield | F16L 29/00 | 137/527 |
| 4,407,482 | A * | 10/1983 | Daghe | F16K 27/00 | 285/321 |
| 4,815,771 | A * | 3/1989 | Paspati | F16L 37/113 | 285/263 |
| 6,193,285 | B1 * | 2/2001 | Proctor | F24F 13/0209 | 285/110 |
| 6,422,232 | B1 * | 7/2002 | Ashton | F21H 1/00 | 362/253 |
| D489,125 | S * | 4/2004 | Drake | D23/386 | |
| 8,734,928 | B1 * | 5/2014 | LaVigna | A41D 31/08 | 428/920 |
| 2001/0037804 | A1 | 11/2001 | Waters et al. | | |
| 2002/0023636 | A1 * | 2/2002 | Ashton | F21H 1/00 | 126/92 R |
| 2003/0056782 | A1 * | 3/2003 | Liang | F24C 1/12 | 126/92 R |
| 2006/0198084 | A1 * | 9/2006 | Hall, Jr. | H05B 3/008 | 361/600 |
| 2007/0101983 | A1 * | 5/2007 | Yao | F24C 1/14 | 126/92 B |
| 2010/0288268 | A1 * | 11/2010 | O'Connell | F24C 1/10 | 126/92 AC |
| 2013/0167835 | A1 * | 7/2013 | Zhu | F24C 15/22 | 126/91 R |
| 2018/0180291 | A1 * | 6/2018 | Wei | F24C 1/12 | |

FOREIGN PATENT DOCUMENTS

| | | | | |
|---|---|---|---|---|
| CN | 201421137 | | 3/2010 | |
| CN | 210463210 | | 5/2020 | |
| CN | 214949349 | | 11/2021 | |
| CN | 214949349 | U * | 11/2021 | |
| DE | 202018104896 | U1 * | 11/2018 | F24C 3/042 |
| WO | WO-2009146421 | A1 * | 12/2009 | F24C 1/12 |

OTHER PUBLICATIONS

"Written Opinion of the International Searching Authority (Form PCT/ISA/237) of PCT/CN2023/080185," mailed on Jul. 12, 2023, pp. 1-4.

* cited by examiner

UMBRELLA-SHAPED HEATER

CROSS-REFERENCE TO RELATED APPLICATION

This application is a 371 of international application of PCT application serial no. PCT/CN2023/080185, filed on Mar. 8, 2023, which claims the priority benefit of U.S. provisional application No. 63/321,766, filed on Mar. 20, 2022. The entirety of each of the above mentioned patent applications is hereby incorporated by reference herein and made a part of this specification.

BACKGROUND OF THE INVENTION

Technical Field

The invention relates to heating equipment, in particular to an umbrella-shaped heater.

Description of Related Art

An umbrella-shaped heater is heating equipment using gas combustion technology. The umbrella-shaped heater adopts a high-efficiency stainless steel radiating net, a durable and corrosion-free body made of thickened steel plates, and a solid gas cylinder is arranged inside to facilitate operation. Three levels of heat power (high, medium and low) can be provided and adjusted in an arc mode to meet different heat requirements, and the maximum power is 15 KW or more, which is six times that of general heaters. Liquefied gas (natural gas) is used as fuel, which is dust-free, odourless, noiseless, efficient and environmentally friendly, and has a combustion rate of 99.9%.

The existing umbrella-shaped heater generally comprises a gas tank arranged on the bottom, which is covered by a metal housing, a gas pipe is connected to the top of the gas tank, a burner is arranged above a support pipe, and a top cover is arranged above the burner for reflecting heat. However, the existing umbrella-shaped heater is very large, so the packaging cost is high, especially considering the increase of export container charge now, the transportation cost is increased a lot. Besides, the angle of the top cover cannot be adjusted, so the reflection angle is limited, which cannot meet the use requirements of users.

BRIEF SUMMARY OF THE INVENTION

The invention provides an umbrella-shaped heater with detachable components, thereby greatly reducing the packaging volume, reducing the transportation cost and improving the economic effectiveness, and moreover, the angle of a top cover can be adjusted to meet the use requirements of different users. The invention solves the technical problems in the prior art that an umbrella-shaped heater is of an integral structure, so the packaging volume is large and the transportation cost is high, and moreover, the angle of a top cover cannot be adjusted.

The technical problems of the invention are solved by the following technical scheme. An umbrella-shaped heater comprises a base component, a support pipe and a burner component;

wherein the base component comprises a base for receiving a gas tank;

the base component further comprises a base frame which is located outside the gas tank, the gas tank is placed on the base, then the base frame can limit the gas tank in the circumferential direction, and the base frame can also be used for fixing the base on the support pipe; and the base component also comprises a housing which is located outside the base frame and used for shielding the gas tank, the housing is flexible, and the base frame can also support the housing in the circumferential direction and provide an installation space for the gas tank around the support pipe.

The support pipe is used for supporting the burner and receiving a gas pipeline, and both ends of the gas pipeline are respectively connected with the burner and the gas tank;

the burner component comprises a burner, and the burner is connected with a control switch; and the burner component also comprises a top cover which is located above the burner and used for reflecting the heat of the burner.

The housing is only to protect the gas tank from being exposed, and does not provide force or load bearing functions. A hard housing adopted in the prior art is large and high in production and transportation cost. A flexible housing is soft, foldable, small in size and convenient to transport, which greatly reduces the production cost and transportation cost. When all the components of the product are packed and transported to a specific place and ready for assembly, the burner component is assembled and the gas tank is placed on the base first, and then the flexible housing can be directly opened and sleeved outside the base frame.

In order to keep the flexible housing smooth outside the base frame and improve the overall appearance of the umbrella-shaped heater, it is preferable to provide a housing smoothening structure on the housing, which helps the housing stay smooth when covering the base frame. The housing smoothening structure provides an upward pushing force and a downward pulling force for the housing, so that the flexible housing is smooth outside the base frame.

Preferably, the housing smoothening structure comprises an upper fixing ring which is sleeved on the support pipe, a compression spring is arranged below the fixing ring, and the other end of the compression spring abuts against the base frame. The compression force of the spring abuts against the upper fixing ring, providing an upward pulling force for the flexible housing.

Preferably, the housing smoothening structure further comprises a lower fixing part which is located below the housing, the lower fixing part is a metal part, a magnet is arranged under the base, and the lower fixing part adheres to the base to smoothen the housing. The lower fixing ring is attracted by the magnet of the base, to provide a downward pulling force for the flexible cover.

The lower fixing part may be uniformly distributed arc blocks at a lower ring of the housing, or may be an integral annular body installed below the housing. Preferably, the lower fixing part is a metal ring, and the metal ring penetrates through a bottom surface of the housing.

Preferably, the housing is made of a textile material or a plastic material, including but not limited to polyester, PG cloth, nylon cloth, Oxford cloth and canvas.

Preferably, the top cover is umbrella-shaped, and the top cover is a bean-pattern plate, a waved plate or a plate with concave-convex patterns formed on the surface, which can improve heat reflection efficiency.

As a preference, the top cover is integrally formed.

As another preference, the top cover is formed by splicing 2-9 top cover plates, and adjacent top cover plates are connected through connectors. The connector is a strip-shaped connecting plate, two sides of the connecting plate are each provided with an insertion groove, and the top cover plates are inserted into the insertion grooves, and then fixed by screws. The top cover plate is small in size and convenient to transport, thus lowering the cost.

Preferably, a reflecting surface adjusting structure is also installed on the top cover, and the reflecting surface adjusting structure is used for adjusting the angle of the top cover. The reflecting surface adjusting structure comprises an adjusting stand fixed above the burner, and the adjusting stand comprises two parallel adjusting plates, which are provided with guide rail grooves. A positioning shaft is arranged below the top cover, two ends of the positioning shaft are located in the guide rail grooves of the two adjusting plates, and the length of the positioning shaft is slightly larger than the distance between the two adjusting plates. According to the needs of users, the angle of the top cover is adjusted by means of the reflecting surface adjusting structure, to obtain the maximum heating area.

Preferably, the guide rail grooves comprise a horizontal guide rail groove and an inclined guide rail groove, and the horizontal guide rail groove and the inclined guide rail groove do not communicate. A starting end of the inclined guide rail groove and the horizontal guide rail groove are located on the same straight line, which ensures the position of the top cover. The top cover can be horizontal or inclined.

Preferably, parallel baffles are fixed below the top cover, two parallel positioning shafts are fixed between the two baffles, and the ends of the positioning shafts pass through the guide rail grooves to be fixed on the baffles, wherein one positioning shaft is located in the horizontal guide rail grooves and the other positioning shaft is located in the inclined guide rail grooves. The positioning shaft in the horizontal guide rail grooves is a horizontal positioning shaft, the positioning shaft in the inclined guide rail grooves is an inclined positioning shaft, the horizontal positioning shaft determines the position of the top cover, and the inclined positioning shaft is just a follower which is to support the top cover.

As a preference, a starting end and a terminal end of the horizontal guide rail groove are each provided with a positioning groove. When the horizontal positioning shaft is located in the positioning groove, the inclined positioning shaft is located at the starting end of the inclined guide rail groove, and the two positioning shafts are located on the same straight line, so that the top cover is horizontal. When the horizontal positioning shaft is located at the terminal end of the horizontal guide rail groove, the inclined positioning shaft is located in the inclined positioning groove to support the top cover, so that the top cover is arranged at an inclined angle, that is, the angle adjustment of the top cover is realized.

In order to realize infinite adjustment, as another preference, a plurality of positioning grooves are uniformly distributed on the horizontal guide rail groove. When the horizontal positioning shaft is located in different positioning grooves, the top cover is at different angles.

Preferably, the positioning shaft can be sleeved with a hook rod, a hook at a front end of the hook rod is sleeved on the positioning shaft, and the positioning shaft is pushed or pulled by the hook rod to move along the horizontal guide rail grooves. The hook at the front end of the hook rod is hooked on the positioning shaft. By operating the hook rod, the horizontal positioning shaft is driven to move in the horizontal guide rail groove to determine the position of the horizontal positioning shaft, thus realizing the adjustment of the position of the top cover.

Preferably, a push rod is hinged on the positioning shaft for pushing or pulling the positioning shaft to move along the horizontal guide rail grooves.

Preferably, the burner comprises at least one circle of fire holes, and there may be two or three circles.

Preferably, the support pipe is of a segmented structure which is formed by connecting a plurality of hollow pipes, and sealing rings are arranged between every two adjacent hollow pipes.

Preferably, adjacent hollow pipes are connected by threads, or adjacent hollow pipes are connected by snap joints.

The flexible housing can be easily folded, to reduce the packaging volume of the whole umbrella-shaped heater. Besides, the support pipe is of a segmented structure, and the top cover is formed by splicing a plurality of top cover plates, thus further reducing the packaging volume and the transportation cost and improving the economic effectiveness. Moreover, the reflecting surface adjusting structure is installed on the top cover, so that the angle or direction of a reflecting surface of the top cover can be changed, thus meeting the needs of users for different angles.

Therefore, the umbrella-shaped heater of the invention has the following advantages: by dividing the top cover into a plurality of top cover plates, dividing the support pipe into a plurality of branch pipes, and making the housing flexible, the packaging volume can be greatly reduced, thereby reducing the transportation cost and improving the economic effectiveness; besides, the reflecting surface adjusting structure is installed on the top cover, which can adjust the angle and range of the reflecting surface of the top cover according to the needs of users, thus improving the flexibility of the product.

DETAILED DESCRIPTION OF THE INVENTION

The technical scheme of the invention will be further explained in detail below through embodiments with reference to the attached drawings.

Embodiment 1

Figure 1:
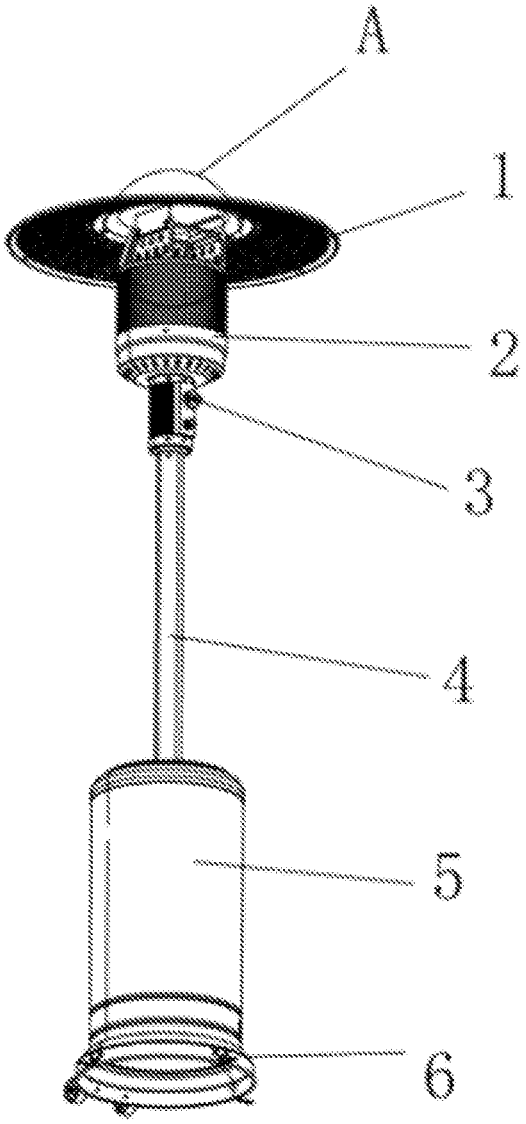
FIG. 1 is a perspective view of an umbrella-shaped heater of the invention.
Figure 2:
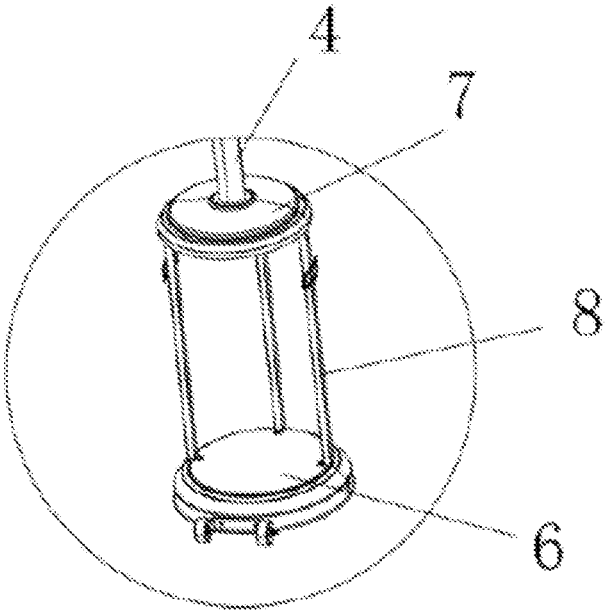
FIG. 2 is an enlarged view of a base support frame in Embodiment 1.
Figure 3:
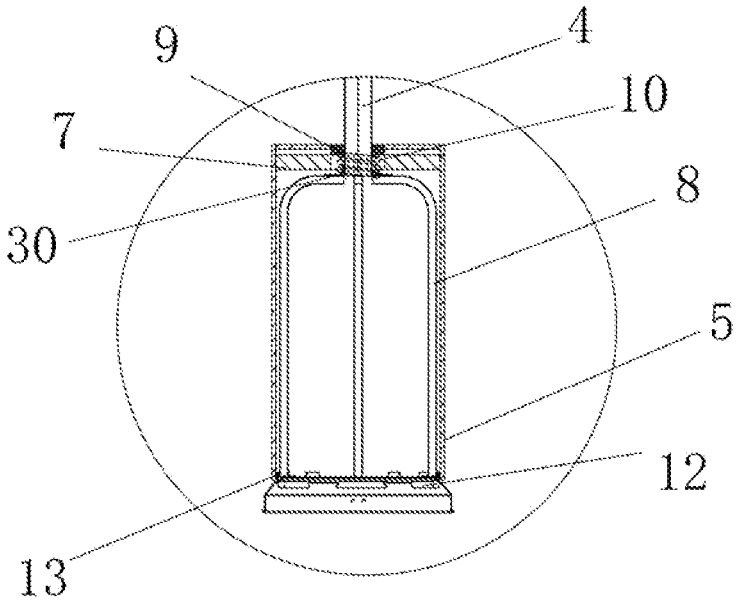
FIG. 3 is a cross-sectional view of a base component in Embodiment 1.

As shown in FIGS. 1, 2 and 3, an umbrella-shaped heater comprises a top cover 1, a burner 2 provided with a burner switch 3, a support pipe 4 and a base frame sequentially from top to bottom, wherein the base frame is sleeved with a housing 5, and a base 6 is arranged below the base frame.

The base 6 is circular and welded to the base frame. The base frame is composed of three support rods 8, two of which are located on the same diameter, and the three support rods 8 form an isosceles triangle. One end of each support rod 8 is welded on the base 6, and the other end of the support rod 8 is welded on a fixing piece 30 which is integrally formed with the support pipe 4, and the fixing piece 30 is located at the end of the support pipe 4. The gas tank is put onto the base from between two adjacent support rods. An upper cover 7 is installed on the base frame. The upper cover 7 is in a circular shape, and is sleeved outside the support pipe 4. The bottom surface of the upper cover 7 is supported by a fixing piece 30. The base frame is sleeved with the housing 5, the housing 5 covers the gas tank and the base frame from the upper cover 7, and the housing 5 is made of nylon cloth. A metal upper fixing ring 9 is sewn to a center of the housing and sleeved on the support pipe 4, and a compression spring 10 is installed below the upper fixing ring 9. One end of the compression spring 10 abuts against the upper fixing ring 9, and the other end of the compression spring 10 abuts against the fixing piece 30. The housing is cylindrical, a lower fixing ring 13 is sewn to a lower end of the housing, and the lower fixing ring 13 is an annular metal ring. A magnet 12 is installed on a lower bottom surface of the base, which attracts the lower fixing ring to the base 6, and at the same time, the elastic force of the compression spring 10 pushes the upper fixing ring 9 upward, thus smoothening the flexible housing made of nylon cloth.

Figure 4:
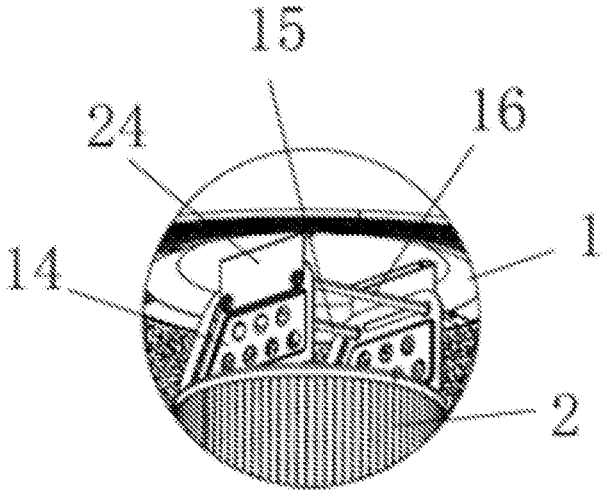
FIG. 4 is an enlarged view at A in Embodiment 1.
Figure 5:
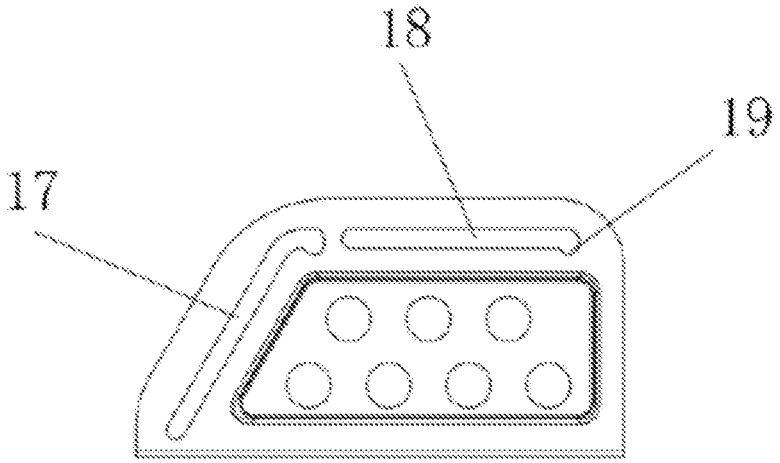
FIG. 5 is a schematic view of an adjusting plate in FIG. 4.

As shown in FIGS. 4 and 5, the support pipe 4 is a hollow pipe, the burner 2 is connected to an upper end of the support pipe 4, and the burner 2 has 2-3 rows of fire holes. Two adjusting plates 14 parallel to each other are installed above the burner 2, and the adjusting plates 14 are in the shape of a right-angled trapezoid. The two adjusting plates 14 constitute an adjusting stand. An upper horizontal edge of the adjusting plate 14 is provided with a horizontal guide rail groove 18, an inclined edge of the adjusting plate is provided with an inclined guide rail groove 17, and a starting end of the inclined guide rail groove 17 is located on the same straight line with the horizontal guide rail groove 18. The horizontal guide rail groove 18 and the inclined guide rail groove 17 do not communicate. A concave positioning groove 19 is formed in a starting end of the horizontal guide rail groove 18.

Figure 6:
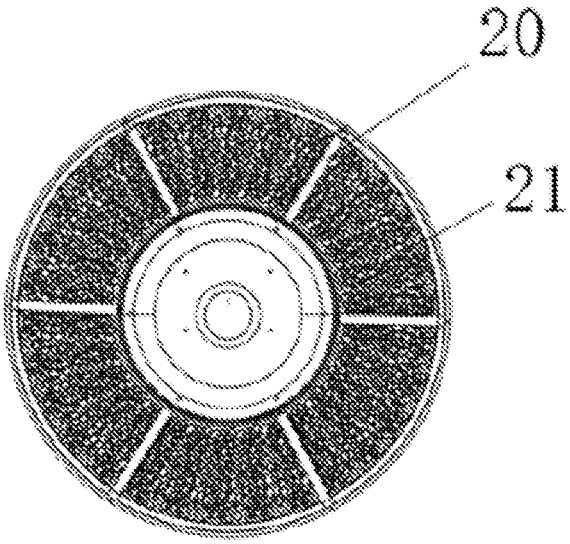
FIG. 6 is a schematic view of a top cover in Embodiment 1.

As shown in FIG. 6, the top cover 1 is installed above the adjusting stand, and the top cover is formed by splicing a plurality of fan-shaped bean-pattern plates 21 with the same size. Adjacent bean-pattern plates 21 are connected by strip-shaped connectors 20, the cross section of the connector 20 is H-shaped, two sides of the connector are provided with insertion grooves, and the bean-pattern plates are inserted into the insertion grooves and then fixed on the connectors by screws.

Two parallel baffles 24 are installed below the top cover 1, two parallel positioning shafts are fixed between the two baffles 24, and the ends of the positioning shafts pass through the guide rail grooves on the adjusting plates and are then fixed by nuts. One of the two positioning shafts is located in the horizontal guide rail grooves, which is called a horizontal positioning shaft 16; and the other one is located in the inclined guide rail grooves, which is called an inclined positioning shaft 15.

When the horizontal positioning shaft 16 is located in the positioning grooves 19 of the horizontal guide rail grooves 18, the inclined positioning shaft 15 is located at the starting ends of the inclined positioning grooves 17, thus ensuring that the top cover is in a horizontal state.

When the horizontal positioning shaft moves to the tail ends of the horizontal guide rail grooves, the inclined positioning shaft slides down along the inclined positioning grooves, and the top cover tilts. Because the horizontal guide rail groove and the inclined guide rail groove do not communicate, when the horizontal positioning shaft moves to the tail ends of the horizontal guide rail grooves, the horizontal positioning shaft will not slide backwards to the starting end due to the gravity of the top cover, so that the top cover is in an inclined state.

Of course, when the top cover is adjusted, the top cover can be driven by a hook rod with a hook, the hook is hung on the horizontal positioning shaft through the hook rod, and then the horizontal positioning shaft is pulled or pushed to move in the horizontal guide rail, thus realizing angle adjustment of the top cover.

Embodiment 2

Figure 7:
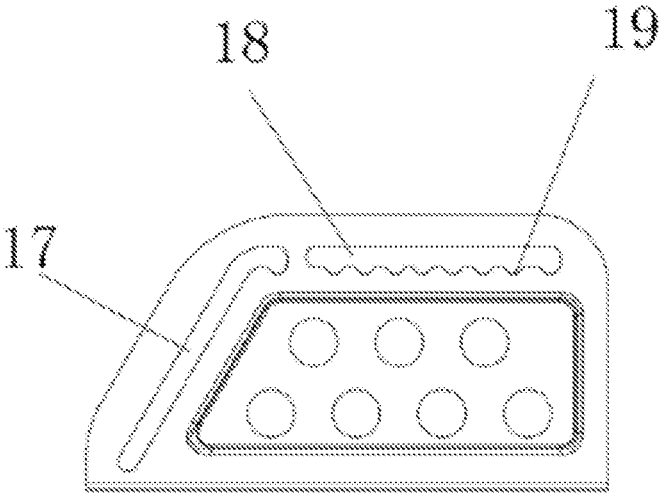
FIG. 7 is a schematic diagram of a reflecting surface adjusting structure of an umbrella-shaped heater in Embodiment 2.

As shown in FIG. 7, different from Embodiment 1, a plurality of positioning grooves 19 are uniformly distributed on the horizontal guide rail groove 18 on the adjusting plate. When the horizontal positioning shaft 16 is located in different positioning grooves 19, the inclination angle of the top cover is different, thus realizing angle adjustment of the top cover.

Embodiment 3

Figure 8:
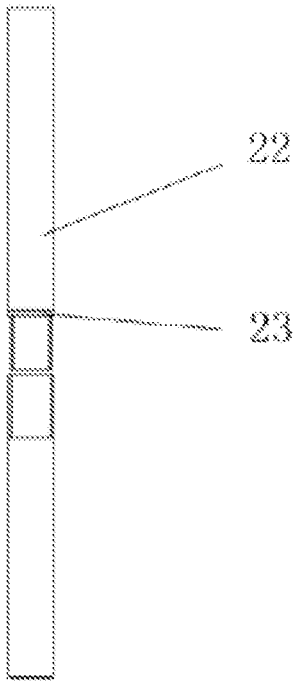
FIG. 8 is a schematic view of a support pipe in Embodiment 3.

As shown in FIG. 8, different from Embodiments 1 and 2, the support pipe is composed of a plurality of hollow pipes 22, sealing rings 23 are sleeved between adjacent hollow pipes, and adjacent hollow pipes are connected by threads.

Embodiment 4

Figure 9:
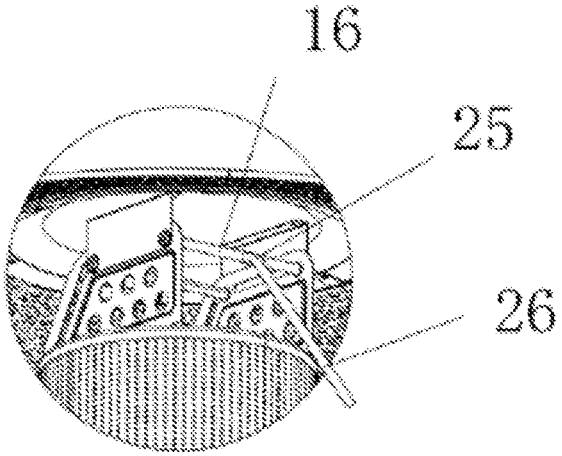
FIG. 9 is a schematic diagram of top cover adjustment in Embodiment 4.

As shown in FIG. 9, different from Embodiments 1 and 2, a push rod 26 is hinged on the horizontal positioning shaft through a hinge 25 for pushing or pulling the positioning shaft 16 to move along the horizontal guide rail grooves.

What is claimed is:

1. An umbrella-shaped heater, comprising:

a base component, a support pipe and a burner component;

wherein the base component comprises a base for receiving a gas tank;

the base component further comprises a base frame which is located outside the gas tank and fixed on the support pipe;

the base component also comprises a housing which is located outside the base frame and used for shielding the gas tank, and the housing is flexible, wherein a housing smoothening structure is installed on the housing, which helps the housing stay smooth when covering the base frame, wherein the housing smoothening structure comprises an upper fixing part which is sleeved on the support pipe, a compression spring is arranged below the upper fixing part, and the other end of the compression spring abuts against the base frame;

the support pipe is used for supporting a burner and receiving a gas pipeline, and both ends of the gas pipeline are respectively connected with the burner and the gas tank;

the burner component comprises the burner, and the burner is connected with a control switch; and the burner component also comprises a top cover which is located above the burner and used for reflecting the heat of the burner.

2. The umbrella-shaped heater according to claim 1, wherein the housing smoothening structure further comprises a lower fixing part which is located below the housing, the lower fixing part is a metal part, a magnet is arranged under the base, and the lower fixing part adheres to the base to smoothen the housing.

3. The umbrella-shaped heater according to claim 2, wherein the lower fixing part is a metal ring, and the metal ring penetrates through a bottom surface of the housing.

4. The umbrella-shaped heater according to claim 1, wherein the housing is made of a textile material or a plastic material.

5. The umbrella-shaped heater according to claim 1, wherein the top cover is umbrella-shaped, and the top cover is a bean-pattern plate, a waved plate or a plate with concave-convex patterns formed on the surface.

6. The umbrella-shaped heater according to claim 1, wherein the top cover is integrally formed.

7. The umbrella-shaped heater according to claim 1, wherein the top cover is formed by splicing 2-9 top cover plates, and adjacent top cover plates are connected through connectors.

8. The umbrella-shaped heater according to claim 1, wherein the burner comprises at least one circle of fire holes.

9. The umbrella-shaped heater according to claim 1, wherein the support pipe is of a segmented structure which is formed by connecting a plurality of hollow pipes, and sealing rings are arranged between every two adjacent hollow pipes.

10. The umbrella-shaped heater according to claim 9, wherein adjacent hollow pipes are connected by threads, or adjacent hollow pipes are connected by snap joints.

11. An umbrella-shaped heater, comprising:

a base component, a support pipe and a burner component;

wherein the base component comprises a base for receiving a gas tank;

the base component further comprises a base frame which is located outside the gas tank and fixed on the support pipe;

the base component also comprises a housing which is located outside the base frame and used for shielding the gas tank, and the housing is flexible;

the support pipe is used for supporting a burner and receiving a gas pipeline, and both ends of the gas pipeline are respectively connected with the burner and the gas tank;

the burner component comprises the burner, and the burner is connected with a control switch; and the burner component also comprises a top cover which is located above the burner and used for reflecting the heat of the burner, wherein a reflecting surface adjusting structure is also installed on the top cover, and the reflecting surface adjusting structure is used for adjusting the angle of the top cover; the reflecting surface adjusting structure comprises an adjusting stand fixed above the burner, and the adjusting stand comprises two parallel adjusting plates, which are provided with guide rail grooves; and a positioning shaft is arranged below the top cover, two ends of the positioning shaft are located in the guide rail grooves of the two adjusting plates, and a length of the positioning shaft is slightly larger than a distance between the two adjusting plates.

12. The umbrella-shaped heater according to claim 11, wherein the guide rail grooves comprise horizontal guide rail grooves and an inclined guide rail grooves, the horizontal guide rail grooves and the inclined guide rail grooves do not communicate, and a starting end of the inclined guide rail grooves and the horizontal guide rail grooves are located on a same straight line.

13. The umbrella-shaped heater according to claim 12, wherein parallel baffles are fixed below the top cover, two parallel positioning shafts are fixed between the baffles, ends of the positioning shafts pass through the guide rail grooves to be fixed on the baffles, and one positioning shaft is located in the horizontal guide rail grooves and the other positioning shaft is located in the inclined guide rail grooves; and the positioning shaft in the horizontal guide rail grooves is a horizontal positioning shaft, and the positioning shaft in the inclined guide rail grooves is an inclined positioning shaft.

14. The umbrella-shaped heater according to claim 12, wherein a positioning groove is formed in a starting end of the horizontal guide rail grooves.

15. The umbrella-shaped heater according to claim 12, wherein a plurality of positioning grooves are uniformly formed in the horizontal guide rail grooves.

16. The umbrella-shaped heater according to claim 12, wherein the positioning shaft is configured to be sleeved with a hook rod, and a hook at a front end of the hook rod is sleeved on the positioning shaft, and the positioning shaft is pushed or pulled by the hook rod to move along the horizontal guide rail grooves.

17. The umbrella-shaped heater according to claim 12, wherein a push rod is hinged on the positioning shaft for pushing or pulling the positioning shaft to move along the horizontal guide rail grooves.

* * * * *